United States Patent [19]

Grahmann et al.

[11] Patent Number: 4,469,983

[45] Date of Patent: Sep. 4, 1984

[54] ELECTRIC LAMP WITH AN ENVELOPE SEAL DESIGNED AS PINCH SEAL, AND A DEVICE AND METHOD FOR ITS MANUFACTURE

[75] Inventors: Helmut Grahmann, Friedberg; Dieter Hofmann, Augsburg; Alfred Wacker, Friedberg, all of Fed. Rep. of Germany

[73] Assignee: Patent-Treuhand-Gesellschaft für Elektrische Glühlampen mbH, Munich, Fed. Rep. of Germany

[21] Appl. No.: 350,036

[22] Filed: Feb. 18, 1982

[30] Foreign Application Priority Data

Mar. 31, 1981 [DE] Fed. Rep. of Germany ..... 3112821

[51] Int. Cl.[3] ..... H01J 5/38; H01K 1/38

[52] U.S. Cl. ..... 313/318; 313/578; 313/613; 313/623; 445/22; 445/26; 445/27

[58] Field of Search ..... 313/318, 578, 613, 623; 445/22, 26, 27

[56] References Cited

U.S. PATENT DOCUMENTS

| | | | |
|---|---|---|---|
| 3,441,778 | 4/1969 | Deiss | 313/318 |
| 3,500,105 | 3/1970 | Westlund, Jr. et al. | 313/318 |
| 3,777,207 | 12/1973 | Notelteirs et al. | 313/578 |
| 4,262,229 | 4/1981 | Bienvenue et al. | 313/318 X |
| 4,307,318 | 12/1981 | Nixon | 313/318 X |
| 4,434,386 | 2/1984 | Lowe | 313/331 |

*Primary Examiner*—David K. Moore
*Assistant Examiner*—Vincent DeLuca
*Attorney, Agent, or Firm*—Frishauf, Holtz, Goodman & Woodward

[57] ABSTRACT

The lamp has a pinch seal which surrounds a mounting structure carrying lead-in wires of the filament;

the front face (7) terminating the lamp envelope end forms substantially a plane, and is arranged at right angle to the generated surface of the lamp envelope (1) with the transition of these two surfaces to one another being substantially in the shape of a circumferential edge, the length of the pinch seal (2) extending from the front face (7) on the axis of the lamp envelope is from 0.2 to 0.4 times the external diameter of the lamp envelope (1), and the width of the pinch seal is close to the external diameter of the lamp envelope. To form this shape, the lamp is introduced into a die, with the envelope softened and, during execution of the pinch operation, excess gas pressure is applied to the interior of the lamp envelope so that the lamp envelope will accurately follow the shape of the pinch jaws similar to a blow-molding operation. The excess gas can be introduced into the lamp envelope for example through an exhaust tube forming part of the mounting structure, which is later on used for exhaustion and filling of the lamp and then sealed off.

20 Claims, 8 Drawing Figures

ELECTRIC LAMP WITH AN ENVELOPE SEAL DESIGNED AS PINCH SEAL, AND A DEVICE AND METHOD FOR ITS MANUFACTURE

The invention relates to an electric lamp having an envelope seal designed as a pinch seal, in which a mounting structure comprising two lead-in wires between which a filament extends and, if required, a support and an exhaust tube is fused to one end of a tubular lamp envelope of glass.

Envelope seals of the above described type are known. Their application extends to lamp envelopes having a certain diameter range, the upper limit thereof being determined by manufacturing feasibility. With increasing lamp envelope diameters, the glass masses which became greater, became difficult to cope with, the length and/or the width of the pinch seal taking undesired dimensions. When the diameters become larger, the pinch seal technique is thus abandoned and the stem-sealing method is used. A flange tube is provided, as a rule, with two multiple-part lead-in wires and a filament extending therebetween and, if required, a support and an exhaust tube, this assembly forming the lamp stem which is then fused to the lamp envelope end to be sealed.

Another type of envelope sealing may be effected with the aid of a pressed glass stem which also contains substantially the above mentioned components. Both methods have in common that, prior to the sealing process proper, a stem portion has to be manufactured which requires additional semi-finished products and machinery.

THE INVENTION

It is an object to avoid the high material requirements and and costs involved in the above described type of manufacture and to make the less expensive pinch sealing technique usable also in lamp envelope seals having a larger diameter.

Briefly, the front face terminating the lamp envelope end forms substantially a plane and is arranged at right angle to the generated surface of the lamp envelope, the transition of these two surfaces being substantially in the shape of a circumferential edge, and the length of the pinch seal extending from the front face on the axis of the lamp envelope being from 0.2 to 0.4 times the external diameter of the lamp envelope and the width of the pinch seal being as large as or smaller than the external diameter of the lamp envelope. The cross section of the pinch seal is substantially rectangular. The lead-in wires consist preferably of one piece, and their coefficient of thermal expansion is matched to that of the glass.

In a preferred embodiment, this type of pinch seal may be used in low pressure mercury vapor discharge lamps, e.g., fluorescent lamps, each of the two lamp ends having such a pinch seal. Each lamp end is provided with a support to which is affixed a member shielding the filament. At least one of the two lamp envelope ends is provided with an exhaust tube through which the lamp is evacuated and filled and which is subsequently tipped off adjacent the pinch seal. The exhaust tube and lamp envelope preferably consist of the same material.

The device for manufacturing an electric lamp in accordance with the invention comprises substantially a pair of pinch jaws whose surfaces which effect the pinching operation correspond to the desired shape of the lamp envelope end. Immediately after the pinching operation—while the lamp envelope end is softened and the pinch jaws are closed—the interior of the lamp envelope is exposed to a certain excess pressure, whereby the pinch seal takes its final shape. By a technique akin to blow-molding the generated surface of the lamp envelope to the substantially plane front face arranged at a right angle is produced. The method is especially applicable to produce the relatively angular transitions of the generated surface of the lamp envelope to the substantially plane front face.

The described pinch seal is not limited to low pressure mercury vapor discharge lamps. Incandescent lamps with a glass envelope may be manufactured in the same way; no major alterations of the technique are required for this purpose. Such lamps also require for a lamp mount two lead-in wires between which a filament extends, as well as, if necessary, a support and an exhaust tube. The support serves in this case as a filament holder.

The electric lamp having an envelope seal in accordance with the invention permits manufacture at lower costs in mass production of both incandescent lamps and discharge lamps as no stem manufacture proper is required. The lamp envelope end to be sealed no longer needs to be performed, such as rolled-up envelope ends of fluorescent lamps. The flange required in the stem manufacture is omitted altogether and the length of the exhaust tube may be reduced. Instead of the usual three-part lead-in wires, single-part lead-in wires can be used. The relatively angular transitions between the generated surface obtained with the novel pinch-sealing technique and the pinch seal which, relative to the external diameter of the lamp envelope, is extremely short, permit bases of conventional construction to be fixed over the pinched lamp envelope end sealed off via the exhaust tube; especially in the case of fluorescent lamps the short bipin bases may be used.

DRAWINGS

Figure 3A:
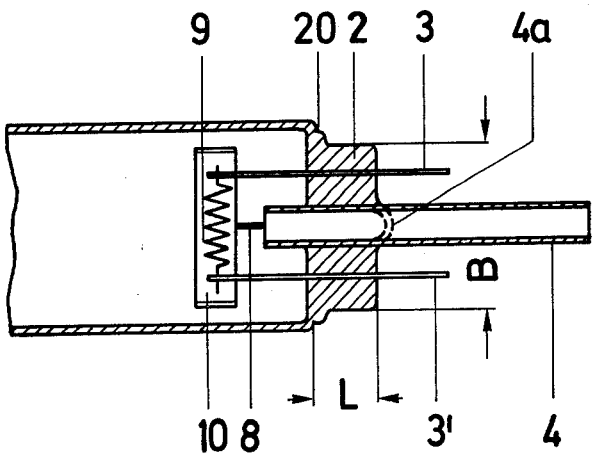
Figure 3B:
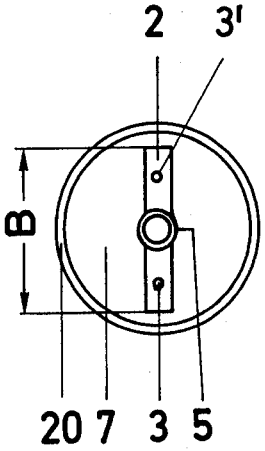
Figure 4:
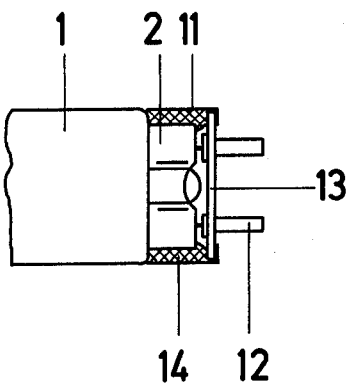
Figure 5:
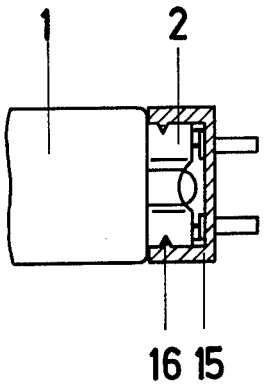
Figure 6:
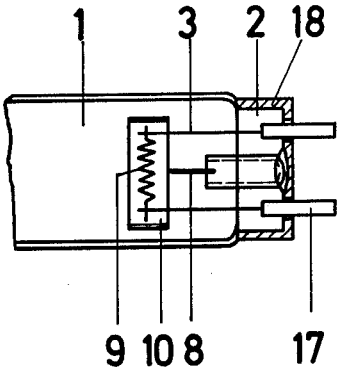
Figure 7:
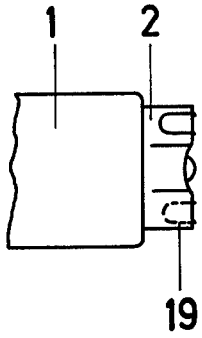

FIG. 3*a* shows a pinch-sealed lamp envelope end as in a fluorescent lamp;

FIG. 3*b* shows the FIG. 3*a* in side view;

FIG. 4 shows a diagrammatic illustration of a fluorescent lamp pinch seal having a base cemented thereto;

FIG. 5 shows a diagrammatic illustration of another example of a fluorescent lamp pinch seal with a base;

FIG. 6 shows a diagrammatic illustration of an alternative practical example of a fluorescent lamp pinch seal with a base;

FIG. 7 shows a diagrammatic illustration of a fluorescent lamp provided with a glass base.

Figure 1:
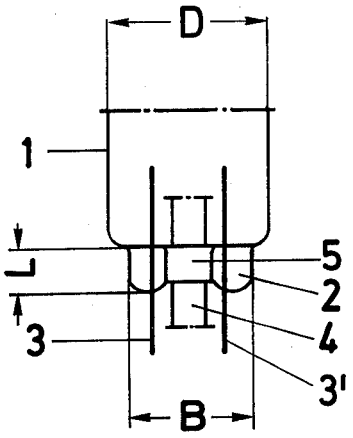
FIG. 1 shows a highly diagrammatic illustration of a pinch seal at a lamp envelope end.

The diagrammatic illustration of FIG. 1 shows a lamp envelope 1 with a pinch seal 2 in which are received two lead-in wires 3, 3' and an exhaust tube 4. The exhaust tube 4 is passed through the middle portion 5 of the pinch seal 2; for this reason, the pinch seal 2 is somewhat thicker at this location (see also FIG. 2).

Figure 2:
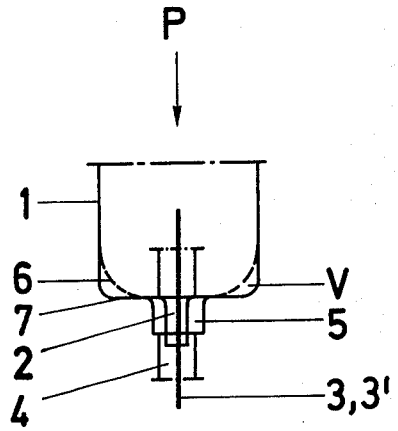
FIG. 2 shows the alteration of the lamp envelope by the mold-blowing.

Method of manufacture with reference to FIG. 2:

In FIG. 2 and in all the other figures, similar parts are designated by the same reference numerals. The end portion of the glass envelope is heated to become soft. Suitable pinch jaws are moved against the softened end. The broken line 6 indicates the lamp envelope shape immediately after the pinching operation. When the pinching jaws are still in the closed position and the glass is still softened from the pinching process, a certain excess pressure P is applied to the interior of the lamp envelope 1 by blowing a gas, e.g. air into it. Because of this excess pressure P, the end of the lamp envelope 1 is blown up expanded by the volume V and is provided with the final shape predetermined by the pinch jaws. The terminating surface which is so formed, i.e. the front face 7 terminating the lamp envelope 1 then forms substantially a plane which is arranged at a right angle to the generated surface of the lamp envelope 1. The transition of these two surfaces to one another is substantially in the shape of a circumferential edge. The length L of the pinch seal 2 extending from the front face 7 is 0.2 to 0.4 times the external diameter D of the lamp envelope 1, and the width B of the pinch seal 2 is smaller than the external diameter D of the lamp envelope 1.

FIg. 3*a* shows a longitudinal section through a fluorescent lamp end provided with a lamp envelope seal in accordance with the invention. The single-part lead-in wires 3, 3' sealed into the pinch seal 2 have a coefficient of thermal expansion which is matched to that of the glass. An oxidized, or, if required, boraxed wire on an iron-nickel basis is particularly suited for the lead-in wires. The external diameter D of the lamp envelope 1 is 25.5 mm (nominally 1 inch); the length L and the width B (FIG. 3*b*) of the pinch seal are 6 mm and 20 mm respectively. The front face 7 is provided with a shoulder 20 of smaller diameter which is concentrical with the external diameter; the badse to be fitted over it later thus is well centered. An annular shield 10 surrounding the incandescent filament 9 is mounted to a support 8. The support 8 may be sealed in the pinch seal 2 and terminate there, or it may be fused to the exhaust tube 4. After the lamp has been evacuated and filled, the exhaust tube 4 is tipped off adjacent the pinch seal 2 so as to constitute a seal 4*a*.

Various practical examples of a based fluorescent lamp are illustrated in the FIGS. 4 to 7. Each case involves a lamp envelope pinch seal as described above. In FIG. 4, the basing has been effected conventionally. A base shell 11 is provided with a base plate 13 into which have been riveted the base pins 12. The base is then affixed to the pinched lamp end by cement 14.

The base 15 in FIG. 5 may be manufactured from plastic. Its outer circumference may be provided with projections 16 with which it engages in corresponding recesses in the pinch seal 2, thus ensuring an additional support and providing far twisting resistance of the joint. In the FIGS. 4 and 5, the lead-in wires are electrically connected to the base pins in known manner, for example by clamping.

In the FIG. 6, the base pins 17 have been electrically connected to the lead-in wires 3 already prior to the pinch sealing operation and have been sealed over part of their length into the pinch seal 2. A shield 18 serves only as a mechanical protection for the pinch seal 2.

The fluorescent lamp of FIG. 7 is provided with a glass base. Here, each of the lead-in wires projecting outwards from the pinch seal 2 is passed back in a curve to the pinch seal 2; the reentrant loops 19 obtained thereby are bent over alternate sides of the pinch seal. Modified holders, however, are required for this type of fluorescent lamp base.

We claim:

1. Integral lamp envelope—pinch seal structure comprising an electric lamp envelope (1) having an end portion of circular cross section;

two lead-in wires (3, 3') extending into the lamp envelope;

a filament (9) extending between the lead-in wires internally of the envelope;

and a pinch seal (2) forming a holding seal for the lead-in wires (3, 3') and closing off the envelope, wherein the structure comprises, in accordance with the invention, a terminating surface (7) integral with the end portion of the envelope, and located in a plane at right angles to the axis of the end portion;

a right-angled transition zone between said terminating surface (7) and the end portion of the envelope, and being substantially in the shape of a circumferential edge, the length of the pinch seal (2) extending from said terminating surface axially with respect to the lamp envelope by a distance of from 0.2 to 0.4 times the external diameter of the end portion of the envelope (1), and wherein the width of the pinch seal extends up to the external diameter of the lamp envelope.

2. Structure as claimed in claim 1, wherein the pinch seal (2) has a substantially rectangular cross section.

3. Structure as claimed in claim 1, wherein the lead-in wires (3, 3') consist of one unitary part.

4. Low-pressure mercury vapor discharge lamp wherein the envelope is an elongated tube;

said lamp comprising two integral lamp envelope—pinch seal structures as claimed in claim 1, one each pinch seal structure being positioned at a respective end of the elongated envelope tube.

5. Lamp as claimed in claim 4, further including an exhaust tube (4) sealed within the pinch seal of at least one of the lamp envelope—pinch seal structures.

6. Lamp as claimed in claim 4, further including an exhaust tube (4) sealed into the pinch seal of both lamp envelope—pinch seal structures.

7. Structure as claimed in claim 1, further including an exhaust tube (4) sealed into the pinch seal (2).

8. Structure as claimed in claim 1, further including an exhaust tube (4) sealed into the pinch seal;

a shield member (10) surrounding the filament;

and a support element (8) connected to and supporting the shield member, and supported on the exhaust tube.

9. A fluorescent lamp structure having a glass envelope (1) of essentially circular cross section, a pinch seal (2) on at least one end of the envelope, two lead-in wires (3, 3') extending through the pinch seal and into the lamp envelope, and a filament (9) extending between the lead-in wires, and comprising, in accordance with the invention, an integral lamp envelope—pinch seal combination structure including a terminating end surface (7) integral with the end portion of the glass envelope, located in a plane at right angles to the outer surface of the fluorescent envelope and forming, with the outer surface of the fluorescent envelope, a right-angled transition in the shape of, substantially, a circumferential edge;

the pinch seal being integral with the end portion of the envelope and said end surface, and consisting of the same material, extending from said end surface (7) along the axis of the lamp envelope for a distance of from 0.2 to 0.4 times the external diameter of the lamp envelope (1), and wherein the width of the pinch seal is up to the external diameter of the lamp envelope.

10. A fluorescent lamp structure as claimed in claim 9, wherein the circumferential edge is formed with an inwardly offset shoulder (20) to provide for centering of a base.

11. A fluorescent lamp structure as claimed in claim 9, wherein the lead-in wires consist of one unitary part.

12. A fluorescent lamp structure as claimed in claim 9, including an exhaust tube (4) sealed into at least one of the pinch seals (2).

13. A fluorescent lamp structure as claimed in claim 9, further including an exhaust tube (4) sealed into the pinch seals at both ends of the fluorescent tube.

14. A fluorescent lamp structure as claimed in claim 9, wherein the pinch seal (2) is of substantially rectangular cross section.

15. A fluorescent lamp structure as claimed in claim 9, further including an exhaust tube (4) sealed into at least one of the pinch seals; and a suport (8) secured to the exhaust tube.

16. Method of manufacturing an electric lamp comprising the steps of:

(a) holding a glass lamp envelope (1) in relation to pinch jaws adjacent an end portion of the glass lamp envelope;

(b) inserting electrode wires (3, 3') into the lamp envelope and to be sealed, and extending inwardly and outwardly of the envelope;

(c) heating the lamp envelope end to be sealed to the softening temperature of the glass;

(d) executing a pinch operation with the pinch jaws against the softened glass envelope end;

(e) applying a predetermined excess gas pressure to the interior of the lamp envelope immediately after the pinching operation and while the glass is still soft and the pinch jaws are still closed to conform the lamp envelope end, and thus its final shape, to the shape of the pinch jaws, and to expand the portion of the envelope adjacent the jaws to form an end surface on the envelope which is integral with the envelope and the pinch, and which is located in a plane and forms, by the excess pressure, a terminating surface (7) located in a plane at right angles to the axis of the lamp envelope, integral with the end portion thereof, and defining with the envelope a right-angled transition zone between said terminating surface and the end portion of the envelope, substantially in the shape of a circumferential edge, the length of the pinch seal (2) extending from said terminating surface along the axis of the lamp envelope of from 0.2 to 0.4 times the external diameter of the end portion of the lamp envelope (1), and wherein the width of the pinch seal is up to the external diameter of the lamp envelope.

17. Method as claimed in claim 16, further including an exhaust tube (4) introduced into the lamp envelope, and extending outwardly thereof;

wherein the step (d) of executing the pinch operation comprises pinching and sealing the exhaust tube into the thus formed pinch;

and wherein the step (e) of applying a predetermined excess gas pressure comprises introducing gas under excess pressure into the lamp envelope through the exhaust tube.

18. Method as claimed in claim 16, wherein the glass lamp envelope comprises an end portion of a fluorescent lamp envelope.

19. Method as claimed in claim 16, including the step of forming the circumferential edge with an inwardly offset shoulder (20) to provide a centering ring for a base.

20. Method as claimed in claim 16, including the step of placing a shield member (10) supported on a support element (8) and an exhaust tube (4) into the lamp envelope prior to executing the pinch operation;

locating the shield member to shield the filament;

and executing the pinch operation (d) with the shield member (10), the support element (8) and the exhaust tube in place.

* * * * *